US005733716A

United States Patent [19]

Goan

[11] Patent Number: 5,733,716

[45] Date of Patent: Mar. 31, 1998

[54] SILVER HALIDE PHOTOGRAPHIC LIGHT SENSITIVE MATERIAL

[75] Inventor: Kazuyoshi Goan, Hino, Japan

[73] Assignee: Konica Corporation, Japan

[21] Appl. No.: 694,396

[22] Filed: Aug. 12, 1996

[30] Foreign Application Priority Data

Aug. 16, 1995 [JP] Japan ..... 7-208848

[51] Int. Cl.[6] ..... G03C 1/043; G03C 1/035; G03C 1/09

[52] U.S. Cl. ..... 430/567; 430/569; 430/605; 430/637; 430/966

[58] Field of Search ..... 430/966, 567, 430/569, 637, 605

[56] References Cited

U.S. PATENT DOCUMENTS

| | | | |
|---|---|---|---|
| 5,252,453 | 10/1993 | Tsaur et al. | 430/569 |
| 5,498,511 | 3/1996 | Yamashita et al. | 430/496 |
| 5,587,281 | 12/1996 | Saitou et al. | 430/567 |

FOREIGN PATENT DOCUMENTS

| | | |
|---|---|---|
| 0513723A1 | 11/1992 | European Pat. Off. . |
| 0618493A2 | 10/1994 | European Pat. Off. . |

OTHER PUBLICATIONS

European Search Report EP 96 30 5958 and Annex.

*Primary Examiner*—Mark F. Huff
*Attorney, Agent, or Firm*—Jordan B. Bierman; Bierman, Muserlian and Lucas

[57] ABSTRACT

A silver halide black-and-white photographic light sensitive material is disclosed, comprising a support having thereon a silver halide emulsion layer comprising silver halide grains, wherein at least 50% of the total grain projected area is accounted for by tabular grains having a chloride content of 20 mol % or more, two parallel {100}major faces and an average aspect ratio of 2 or more, said tabular grains being prepared by nucleating in the presence of a surfactant comprised of polyalkyleneoxide block copolymer.

4 Claims, No Drawings

SILVER HALIDE PHOTOGRAPHIC LIGHT SENSITIVE MATERIAL

FIELD OF THE INVENTION

The present invention relates to a silver halide photographic light sensitive material having a light sensitive silver halide emulsion on a support (hereafter, referred to as a photographic material) and a process for forming an X-ray photographic image, particularly to a photographic material with low fog and high sensitivity, and excellent in graininess and rapid-processability even when replenished at a low rate.

BACKGROUND OF THE INVENTION

Recently, with an increase of consumption of silver halide photographic light sensitive materials, the processing amount thereof is increasing so that there have been demands for further shortening of the processing time.

In the field of X-ray photographic light sensitive materials for medical use, rapid processing is demanded due to the increased number of radiographs caused by the increased frequency of diagnoses and radiographing items necessary for prompt diagnoses. Especially, in the field where processing within a short time is required such as arteriography and radiographing during surgical operation, rapid processing is essential.

To satisfy such demands in the area of the diagnosis, it is necessary to promote automation and the enhancing speed of radiographing and processing operation of the photographic light sensitive materials. Recently, to meet the environment regulation, low replenishment has been advanced to reduce effluents from processing tanks.

However, when processed at a high speed and low replenishment rate, it resulted in processing variations and deterioration in image quality. As well recognized in the art, silver chloride is superior in processability as compared to other silver halides and effect of a chloride ion on a developer is also less than that of a bromide or iodide ion, so that exhaustion of a developer due to accumulation of halide ions can be avoided by the use of silver chloride. However, silver chloride cannot achieve high sensitivity.

To meet the demands for the rapid processing, recently, a tabular silver halide grains have been employed. Since the specific surface area of the tabular silver halide grains is large, sensitizing dye can be adsorbed to the grains in a large amount so that spectral sensitivity is can be enhanced. In addition, cross-over light is remarkably decreased and light-scattering becomes small, so that an image with high resolution can be obtained. The use of the tabular grains, therefore, is expected to lead to a silver halide photographic light sensitive material with high sensitivity and image quality.

Tabular chloride-containing grains with two parallel {100} major faces are disclosed in European Patent 534,395 and U.S. Pat. Nos. 5,264,337 and 5,320,938. These tabular grains, however, were found to be polydispersed and low in sensitivity so that photographic performance sufficient for practical use could not achieved.

A medical radiographic image is usually obtained by the combination of a radiographic intensifying screen and X-ray photographic light sensitive material. In addition to the image quality of the photographic material itself, the intensifying screen largely affects the radiographic image.

Although, in X-ray photographing, a combination of a radiographic screen and a silver halide photographic light sensitive material is not specifically designated, a high emission type intensifying screen is usually employed in combination with a standard speed or high speed silver halide photographic material, in the case of high speed photographing being required, such as photographing lumbar, angiography of the head and enlarged photographing. In the case of making much account of image quality, such as simple photographing of the chest, photographing of the stomach and photographing of bone, a combination of an intensifying screen with high resolution and a silver halide photographic light sensitive material with standard speed is usually employed. A combination of the high emission type intensifying screen with a high speed photographic material results in a lowering of resolution and a combination of a low emission type screen and low speed photographic material, on the other hand, leads to lowering in sensitivity.

Japanese Patent Application open to public inspection Publication (hereinafter, denoted as "JP-A") No. 3-21898 discloses a technique in which sharpness and graininess are enhanced by increasing the filling density of fluorescent substance used in an intensifying screen. JP-A 2-266344 discloses a technique in which a combination of a radiographic light sensitive material having on both sides of a support silver halide emulsion layers different in photographic characteristics and intensifying screens different from each other results in decreased cross-over light, enhanced sharpness and improved latitude for exposure variation. This technique was intended to obtain images with varied contrasts by varying the combination with an intensifying screen. However, it deteriorated graininess in practical use, resulting in impairment in diagnosis.

As factors affecting a medical radiographic image quality are cited graininess, sharpness and contrast of the image. As to the graininess, in the case when photographed using a combination of a standard type photographic material, SR-G and a standard type fluorescent screen, SRO-25 (each, product by Konica) and in a range of 110 kVp or more of X-ray tube voltage, 50% or more of deterioration of graininess is due to quantum mottle, causing the deterioration of graininess and image quality of X-ray photograph. In the case when using a high speed X-ray film, the quantum mottle is further increased, resulting in a lowering of the image quality.

To enhance the image quality of X-ray photograph, it is necessary to hold or enhance sharpness by decreasing the quantum mottle. In the case when causing sharpness of a photographic material to be enhanced by cutting off cross-over light, enhancement of sharpness accompanies deterioration of graininess to some extent so that improvement in image quality is not necessarily achieved. Accordingly, a method in which sharpness and graininess are enhanced by increasing the filling density of the fluorescent substance used in a fluorescent screen, as disclosed in JP-A 3-21898 is conducted.

In the case when using, in combination with a fluorescent screen having 66% or less of a filling ratio of fluorescent substance, a photographic material in which cross-over light is largely cut off, enhancement of sharpness accompanies deterioration of graininess. To balance the graininess and sharpness, therefore, an X-ray photographic material was designed so that cross-over light exceeded 20%. However, the resulting photographic image was insufficient in image quality and further improvements are desired.

SUMMARY OF THE INVENTION

In response to the above-described problems, an object of the present invention is to provide a silver halide photographic light sensitive material with high sensitivity and low fog, excellent in graininess and rapid-processable even at a low replenishing rate, and an X-ray image forming method by the use thereof.

The above problems can be solved by the following means.

(1) A silver halide photographic light sensitive material comprising a support having thereon a light sensitive silver halide emulsion layer, wherein at least 50% of the total projected area of silver halide grains contained in said emulsion layer is accounted for by tabular grains having two parallel {100} major faces, an aspect ratio of 2 or more and a chloride content of 20 mol % or more, said tabular grains being formed through nucleation in the presence of a surfactant of polyalkyleneoxide block copolymer.

(2) The photographic material described in (1), wherein the polyalkyleneoxide copolymer contains two terminal hydrophilic alkyleneoxide block units which are each linked by a hydrophobic alkyleneoxide block unit accounting for 4 to 96% of the molecular weight of the copolymer.

(3) The photographic material described in (1) or (2), wherein said tabular grains is formed by adding a iridium compound during the course of grain formation.

(4) A method for forming an X-ray photographic image, wherein said photographic material described in (1), (2) or (3) is a double emulsion light sensitive material, said photographic material being exposed imagewise to X-ray across a fluorescent intensifying screen capable of absorbing not less than 45% of X-ray with an X-ray energy of 80 kVp and containing a fluorescent substance having a thickness of 135 to 200 μm, in a packing density of not less than 68%.

(5) The X-ray photographic image forming method described in (4) wherein said photographic material is processed by use of an automatic processor provided with a means for supplying a solid processing composition to a processing bath.

(6) The X-ray photographic image forming method described in (4) or (5), wherein said photographic material is processed with a developer or its replenisher containing a compound represented by formula (A), using the automatic processor.

(7) The X-ray photographic image forming method described in (4), (5) or (6), wherein said photographic material is processed by use of the automatic processor within a total processing time of 25 sec. or less.

(8) The X-ray photographic image forming method described in (7), wherein said photographic material is processed at a replenishing rate of a developer and/or fixer of 200 ml/m$^2$ of the photographic material.

DETAILED DESCRIPTION OF THE INVENTION

Silver halide grains are generally prepared or employed in the form of a silver halide emulsion containing the grains. A silver halide emulsion according to the present invention is preferably used for forming a black-and-white photographic image (alternatively, a silver image).

A silver halide emulsion according to the present invention is characterized in that at least 50% of the total grain projected area is accounted for by tabular grains satisfying the following requirements.

a) Parallel major faces are {100} crystal faces, an aspect ratio being 2 or more.

b) A chloride content is 20 mol % or more.

c) Nucleation is performed in the presence of a surfactant of a polyalkyleneoxide copolymer.

The chloride content is preferably not less than 30 mol % and not more than 70 mol %. More preferably, the tabular grains satisfying the above requirements account for not less than 80% of the total grain projected area.

The major faces are herein defined as those having two parallel crystal faces, each of which is substantially larger any other single crystal face constituting a rectangular emulsion grain. The aspect ratio refers to the ratio of a mean edge length of the major faces to a mean thickness.

The mean edge length of the major faces can be determined by photographing the grains magnified by 10,000 to 50,000 time with an electron microscope and measuring an edge length or projected area of the grain in a print. The number of grains to be measured is to be indiscriminately 1,000 or more. The grain thickness can also be determined from electronmicrograph.

The silver halide emulsion according to the present invention is prepared by a process comprising:

(a) incorporating, into a dispersing medium, a silver salt and a halide in the presence of a surfactant of a polyalkyleneoxide block copolymer to form tabular nuclear grains, (b) carrying out Ostwald-ripening of the tabular nuclear grains under such a condition that {100} major faces of the nuclear grains are maintained, and (c) performing grain growth so as to reach desired grain size and chloride content.

It is preferred to incorporate a silver salt and halide by the double jet method (simultaneously-mixing method) to form nuclear grains.

The double jet method is also employed at the stage of the grain growth. A mode of the double jet method is a controlled double jet method, in which a pAg in a liquid phase is maintained at a given value. Thereby, a silver halide emulsion having a regular crystal form and uniform grain size can be obtained.

In a part or all of the grain forming process of the silver halide emulsion according to the invention, the grain growth is performed by supplying silver halide fine grains.

The size of the fine grains controls supplying rates of silver and halide ions, so that the preferred size depends on the size or halide composition of silver halide host grains. The size is preferably 0.3 μm or less in sphere equivalent diameter and, more preferably, 0.1 μm or less. The fine grains deposit on the host grains by recrystallization, so that the fine grain size is preferably smaller than the sphere equivalent diameter of the host grains and more preferably, not more than 1/10 of the sphere equivalent diameter.

Polyalkylene oxide block copolymer surfactant

In the process of preparing the silver halide emulsion of the invention, nucleation is performed in the presence of a polyalkylene oxide block copolymer surfactant. The amount of the surfactant to be added is preferably 0.05% by weight or more per gram of silver and more preferably 0.1 to 10% by weight. The surfactant preferably comprises two terminal hydrophilic alkylene oxide block unit, each attached to a hydrophobic alkylene oxide block unit which accounts for 4 to 96% of the molecular weight of the polyalkylene oxide copolymer. The more preferred surfactant is a compound represented by the following formula (S).

Formula (S)

$$A-O(CH_2CH_2O)_n-(CH(CH_3)CH_2O)_p-(CH_2CH_2O)_m-B$$

In the formula, A and B each represent a hydrogen atom or a substituent; p is an integer of 15 to 25; and m and n each are an integer satisfying the following requirement:

$(m+n)/p=0.24$ to 0.45

At least one of A and B represented by A and B in formula (S) is preferably a substituent. As examples of the substituent are cited a sulfonic acid group (alternatively, sulfo group) including its salts such as alkali metal salts, carboxy group including its salts such as alkali metal salts, alkyl group, aryl group, alkylcarbonyl group, arylcarbonyl group or alkenylcarbonyl group. These groups may be substituted.

Exemplary examples of the compound represented by formula (2) are shown below, but the invention is not limited thereto.

2-1

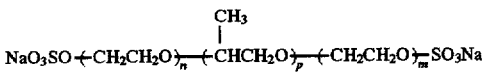

2-2

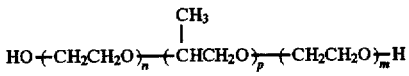

2-3

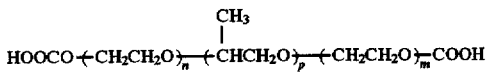

2-4

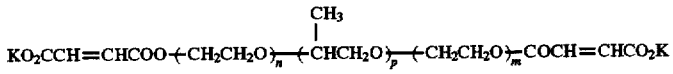

2-5

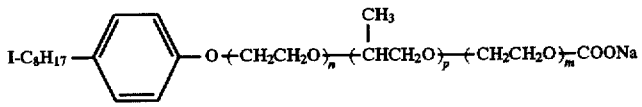

2-6

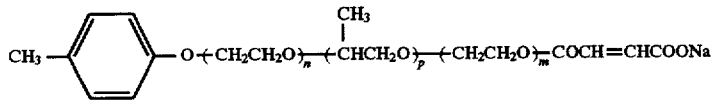

2-7

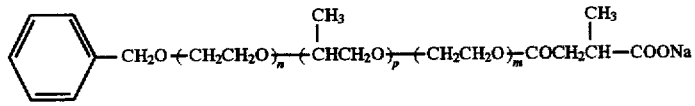

2-8

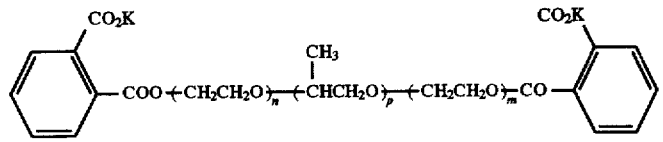

2-9

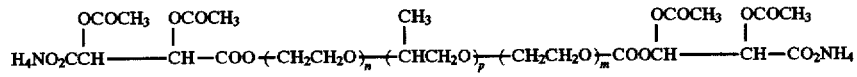

2-10

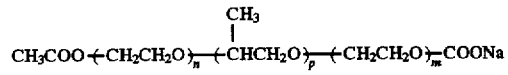

2-11

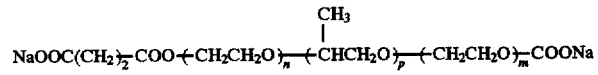

The compound above-described is preferably added by dissolving in a solvent which does not deteriorate photographic performance, such as methanol or acetone.

Iridium compound

During the course of preparing the silver halide emulsion used in the invention, an iridium compound is preferably added. As the iridium compound is usable a water soluble iridium compound. Examples thereof include iridium (III) halides, iridium (IV) halides, iridium complex salts having halogen, amines or oxalates as a ligand, such as hexachloroiridate (III), hexachloroiridate (IV), trioxalatoiridate (III), trioxalatoiridate (IV), etc. In the invention, these iridium (III) compound and iridium (IV) compound may be usable optionally in combination thereof. The iridium compound is dissolved in a suitable solvent, such as water. For the purpose of stabilizing a solution of the iridium compound, a hydrogen halide such as hydrochloric acid, hydrobromic acid and hydrofluoric acid or alkali halide such as KCl, NaCl and NaBr may be added thereto.

Instead of the use of a water soluble iridium compound, silver halide grains occluding iridium as a dopant may be added during precipitation of a silver halide emulsion. The iridium compound used in the invention is added in an amount of not less than $10^{-9}$ mol, preferably $5\times10^{-9}$ to $1\times10^{-4}$ mol, more preferably $1\times10^{-8}$ to $1\times10^{-5}$ mol and further more preferably $5\times10^{-8}$ to $5\times10^{-6}$ mol per mol of silver halide finally obtained.

The iridium compound can be added optionally at any state during grain formation and preferably at the time of nucleation.

Desalting

After completing grain growth, a silver halide emulsion is subjected to desalting such as the noodle washing method or flocculation washing method to remove water soluble salts and make the pAg suitable for chemical sensitization. As preferred washing are cited a technique of using an aromatic hydrocarbon aldehyde resin described in Japanese Patent examined 35-16086 and a technique of using polymeric flocculant, G-3 and G-8 described in JP-A 2-7037. Further, ultrafiltration may be usable, as described in Research Disclosure (RD) Vol.102, 1972, October, Item 10208 and Vol.131, 1975, March, Item 13122.

Binder

In the silver halide emulsion relating to the invention, binder is used as a protective colloid to envelop silver halide. For the purpose thereof, gelatin, synthetic polymer such as polyvinyl alcohol and polyamide, colloidal albumin, polysaccharides and cellulose derivatives are used as a photographic binder.

Chemical ripening

The silver halide emulsion used in the invention is subjected to chemical ripening. The condition in the chemical ripening process, such as pH, pAg, temperature or time is not specifically limited. The chemical ripening is conducted in a manner conventional in the art. Sulfur sensitization with the use of a compound containing sulfur capable of reacting with a silver ion or active gelatin, selenium sensitization with the use of a selenium compound, tellurium sensitization with use of a tellurium compound, reduction sensitization with the use of a reducing compound and noble metal sensitization with the use of gold or other noble metals are used for chemical sensitization singly or in combination thereof. Among these are preferably used the sulfur sensitization, selenium sensitization, tellurium sensitization and reduction sensitization.

Selenium sensitization

Selenium sensitizers usable in the selenium sensitization include various selenium compounds, as described in U.S. Pat. Nos. 1,574,944, 1,602,592 and 1,623,499, JP-A 60-150046, 4-25832, 4-109240 and 4-147250. As examples of usable selenium sensitizers are cited colloidal selenium, isoselenocyanates such as allylisoselenocyanate; selenoureas such as N,N-dimethylselenourea, N,N,N'-triethylselenourea, N,N,N'-trimethyl-N'-heptafluoroselenourea, N,N,N'-trimethyl-N'-heptafluoropropylcarbonylselenourea and N,N,N'-trimethyl-N'-nitrophenylcarbonylselenourea; selenoketones such as selenoacetone and selenoacetophenone; selenoamides such as selenoacetoamide and N,N-dimethylselenobenzamide; selenocarboxylic acids and selenoesters such as 2-selenopropionic acid and methyl-3-selenobutylate; selenophosphates such as tri-p-triselenophosphate; selenides such as triphenylphosphine selenide, diethyl selenide and diethyl selenide. Among these selenium sensitizers are preferred selenoureas, selenoamides, selenoketones and selenides.

Besides the above-described patents, the technique for using the selenium sensitizer are exemplarily described in U.S. Pat. Nos. 3,297,446, 3,297,447, 3,320,069, 3,408,196, 3,408,197, 3,442,653, 3,420,670 and 3,591,385; French Patents 2,63,038 and 2,093,209; Japanese Patents examined 52-34491, 52-34492, 53-295 and 57-22090; JP-A 59-180536, 59-185330, 59-181337, 59-187338, 59-102241, 60-151637, 61-246738, 3-4221, 3-24537, 3-111838, 3-116132, 3-148648, 3-237450, 4-16838, 4-32831, 4-96050, 4-140738, 4-140739, 4-1494374-184331, 4-190225, 4-191729 and 4-195035; British Patents 255,846 and 861, 984. It is also disclosed in H. E. Spencer et al., Journal of photographic Science Vol. 31, pages 158–169 (1983).

Tellurium sensitization

The tellurium sensitization including its sensitizer is described in U.S. Pat. Nos. 1,623,499, 3,320,069, 3,772,031, 3,531,289 and 3,655,394; British Patents 235,211, 1,121, 496, 1,295,462 and 1,396,696; Canadian Patent 800,958; JP-A 4-204640 and 4-333043. As examples of usable tellurium sensitizers are cited telluroureas such as N,N-dimethyltellurourea, tetramethyltellurourea, N-carboxyethyl-N,N'-dimethyltellurourea and N,N'-dimethyl-N'-phenyltellurourea; phosphine tellurides such as tributylphosphine telluride, tricyclohexylphosphine telluride, triisopropylphosphine telluride, butyldiisopropylphosphine telluride and dibutylphenylphosphine telluride; telluroamides such as telluroacetoamide and N,N-dimethyltellurobenzamide; telluroketones; telluroesters and isotellurocyanates.

Technique for using the tellurium sensitizer is similar to that for selenium sensitizer.

Reduction sensitization

The surface of silver halide grains are preferably reduction-sensitized by exposing to suitable reductive environment. As examples of preferred reducing agents are cited thiourea dioxide, ascorbic acid and its derivatives, hydrazines, polyamines such as diethylenetriamine, dimethylamine boranes and sulfites.

Spectral sensitization

The silver halide emulsion used in the invention can be spectrally sensitized by use of various sensitizing dye known in the art, such as cyanine dyes. The sensitizing dye may be used singly or in combination thereof. A combination of the sensitizing dyes is often used for the purpose of supersensitization. In the present invention, the sensitizing dye is required to have photosensitivity in the same wavelength range as the main emission peak of an X-ray intensifying screen. Further, the sensitizing dye may be added in the form of s solid particle dispersion, as described in JP-A 5-297496.

Additives

In a silver halide emulsion used in the invention, various additives may be incorporated in physical ripening, or before, during or after chemical ripening. As the additives, can be employed compounds as described in aforementioned RD Nos. 17643, 18716 and 308119, wherein relevant types of compounds and sections thereof are follows.

| | RD-17643 | | RD-18716 | RD-308119 | |
|---|---|---|---|---|---|
| Additive | Page | Sec. | Page | Page | Sec. |
| Chemical sensitizer | 23 | III | 648 upper right | 996 | III |
| Sensitizing dye | 23 | IV | 648–649 | 996–8 | IV |
| Desensitizing dye | 23 | IV | | 998 | IVB |
| Dye | 25–26 | VIII | 649–650 | 1003 | VIII |
| Developing accelerator | 29 | XXI | 648 upper right | | |
| Antifoggant/ stabilizer | 24 | IV | 649 upper right | 1006–7 | VI |
| Brightening agent | 24 | V | | 998 | V |
| Hardening agent | 26 | X | 651 left | 1004–5 | X |
| Surfactant | 26–27 | XI | 650 right | 1005–6 | XI |
| Plasticizer | 27 | XXI | 650 right | 1006 | XXI |
| Lubricant | 27 | XXI | | | |
| Matting agent | 28 | XVI | 650 right | 1008–9 | XVI |
| Binder | 26 | XXII | | 1003–4 | |
| Support | 28 | XVII | | 1009 | XVII |

Support

As supports used in the photographic material of the invention are cited those described in afore-mentioned RD-17643, page 28 and RD-308119, page 1009. As an optimal support is cited polyethylene terephthalate film. The surface of the support may be sub-coated or exposed to corona discharge or UV-ray.

Coating

The photographic material of the invention is optionally provided with an antihalation layer, interlayer and filter layer.

A silver halide emulsion layer and other hydrophilic colloid layer(s) can be coated on the support or another layer by various coating methods, such as the dip coating method, roller coating method, curtain coating method, extrusion coating method and slide-hopper method. Details thereof are described in Research Disclosure Vol. 176, pages 27–28, Item "Coating procedure".

X-ray intensifying screen

In the case where the present invention is applied to medical radiography, there is employed an X-rat intensifying screen having, as a main component, a fluorescent substance capable of emitting near-ultraviolet ray or visible light when exposed to penetrating radiation. The intensifying screens are brought into contact with both sides of the photo graphic material coated on both sides of the support with emulsion layers and subjected to exposure. The penetrating radiation refers to electromagnetic wave with high energy, such as X-ray and γ-ray.

Preferred fluorescent substances used in the intensifying screen include tungstate fluorescent substances ($CaWO_4$, $MgWO_4$, $CaWO_4$:Pb); terbium-activated rare earth oxysulfide fluorescent substances [$Y_2O_2S$:Tb, $Gd_2O_2S$:Tb, $La_2O_2S$:Tb, $(Y.Gd)_3O_2S$:Tb, $(Y.Gd)O_2S$:Tb.Tm; terbium-activated rare earth phosphate fluorescent substances ($YPO_4$:Tb, $GdPO_4$:Tb, $LaPO_4$:Tb); terbium-activated rare earth oxyhalide fluorescent substances (LaOBr:Tb, LaOBr:Tb, Tm, LaOCl: Tb, Tm, GdOBr:Tb, GdOCl) and thulium-activated rare earth oxyhalide fluorescent substances (LaOBr:Tm, LaOCl:Tm); barium sulfate fluorescent substances [$BaSO_4$Pb, $BaSO_4$:$Eu^{2+}$, $(Ba.Sr)SO_4$:$Eu^{2+}$]; bivalent europium-activated alkali earth metal phosphate fluorescent substances [$(Ba_2PO_4)_2$:$Eu^{2+}$, $(Ba_2PO_4)_2$:$Eu^{2+}$]; bivalent europium-activated alakli earth metal fluorohalide fluorescent substances [BaFCl:$Eu^{2+}$, BaFBr:$Eu^{2+}$, BaFCl:$Eu^{2+}$.Tb, $BaF_2$.BaCl.KCl:$Eu^{2+}$(Ba.Mg)$F_2$.BaCl.KCl:$Eu^{2+}$]; iodide fluorescent substances [ZnS:Ag (Zn.Cd)S:Ag, (Zn.Cd)S:Cu, (Zn.Cd)S:Cu.Al]; hafnium phosphate fluorescent substances ($HfP_2O_7$:Cu); tantalate fluorescent substances ($YTaO_4$, YTaO4:Tm, $YTaO_4$:Nb, [Y,Sr]$TaO_4$:Nb, $GdTaO_4$:Tm, $GD_2O_3.Ta_2O_5.B_2O_5$:Tb].

It is preferred to fill the fluorescent substance in sloped grain structure to form the intensifying screen. Specifically, it is preferred that a fluorescent substance with a large particle size is coated in the surface protective layer-side and another fluorescent substance with smaller particle size is coated in the support-side. The small particle size is in the range of 0.5 to 2.0 μm and larger one is 10 to 30 μm.

For producing the above-mentioned radiographic intensifying screen, it is preferable to produce it by a production method including 1) a step forming a fluorescent substance sheet composed of a binder and a fluorescent substance
2) a step providing the above-mentioned fluorescent substance sheet on a support and adhering the above-mentioned fluorescent substance sheet on the support while compressing at a softening temperature or melting point or more of the above-mentioned binder.

First of all, step 1) will be explained. The fluorescent substance sheet which is a fluorescent substance layer of a radiographic intensifying screen can be produced by coating a coating solution, wherein a fluorescent substance is dispersed uniformly in a binder solution, on a tentative support for forming the fluorescent substance sheet, drying and peeling it off from the tentative support. Namely, first of all, a binder and fluorescent substance particles are added to an appropriate organic solvent and then, stirred to prepare a coating solution wherein the fluorescent substance is dispersed uniformly in the binder solution.

As a binder, a thermoplastic elastomer whose softening temperature or a melting point is 30° to 150° C. is used singly or in combination with other binder polymers. The thermoplastic elastomer has elasticity at room temperature and has fluidity when heated. Therefore, it can prevent damage of the fluorescent substance due to pressure in compression. As examples of a thermo-plastic elastomer, polystyrene, polyolefin, polyurethane, polyester, polyamide, polybutadiene, ethylene vinyl acetate copolymer, poly vinyl chloride, natural rubbers, fluorine-containing rubbers, polyisoprene, chlorinated polyethylene, styrene-butadiene rubbers and silicone rubbers are cited. The component ratio of thermo-plastic elastomer in the binder is allowed to be 10 wt % or more and 100 wt % or less. However, it is desirable that the binder is composed of the thermo-plastic elastomer as much as possible, especially is composed of a thermoplastic elastomer of 100 wt %.

As examples of a solvent for preparing a coating solution, lower alcohols such as methanol, ethanol, n-propanol and n-butanol; chlorine-containing hydrocarbons such as methylenechloride and ethylenechloride; ketones such as acetone, methylethylketone and methylisobutylketone; esters of lower fatty acids and lower alcohols such as methyl acetate, ethyl acetate and butyl acetate; ethers such as dioxane, ethyleneglycolmonoethylether and ethyleneglycoholmonomethylether and their mixtures can be cited. The mixture ratio between the binder and the fluorescent substance in the coating solution varies depending upon the characteristic of the radiographic intensifying screen and the kind of fluorescent substance. Generally, the mixture ratio of the binder and the fluorescent substance is from 1:1 to 1:100 (by weight), and preferably from 1:8 to 1:40 (by weight).

Various additives such as a dispersant for improving dispersing property of a fluorescent substance in aforesaid coating solution and a plasticizer for improving binding force between a binder and a fluorescent substance in the fluorescent substance layer after being formed may be mixed. Examples of a dispersant used for the above-mentioned purpose include phthalic acid, stearic acid, caprolic acid and lipophilic surfactants may be cited. Examples of a plasticizer include phosphates such as triphenyl phosphate, tricresyl phosphate and diphenyl phosphate; phthalates such as diethyl phthalate and dimethoxyethyl phthalate; ester glycols such as ethylphthalylethyl glycolate and butylphthalylbutyl glycolate; and polyesters of polyethylene glycols and aliphatic dibasic acids such as polyester of triethylene glycol and adipic acid and polyester between diethylene glycol and succinic acid are cited. Next, the coating layer is formed by coating the coating solution containing the fluorescent substance and the binder prepared in the above-mentioned manner on the tentative support for forming a sheet uniformly. This coating operation can be conducted by the use of a conventional means such as a doctor blade method, a roll coater method and a knife coater method.

A material of the tentative support can be selected from glass, metal plate or conventional materials as a support for an intensifying screen of X-ray. Examples of such materials include plastic films such as cellulose acetate, polyester, polyethylene terephthalate, polyamide, polyimide, triacetate and polycarbonate, metallic sheets such as aluminium foil and aluminium alloy foil, an ordinary paper, baryta paper, resin-coated paper, pigment paper containing a pigment such as titanium dioxide, paper wherein polyvinyl alcohol is subjected to sizing, ceramic plates or sheets such as alumina, zirconia, magnesia and titania. A coating solution for forming the fluorescent substance layer is coated on the tentative support and dried. Following this, the coating layer is peeled off from the tentative support so that the fluorescent substance sheet which will be a fluorescent substance layer of a radiographic intensifying screen is formed. Therefore, it is desirable that a mold-releasing agent is coated on the surface of the tentative support and that the fluorescent substance sheet formed is easily peeled off from the tentative support.

Next, step 2) will be explained. First of all, a support for a fluorescent substance sheet prepared in the above-mentioned manner is prepared. This support can be selected arbitrarily from the same materials as those used for a tentative support used in forming the fluorescent substance sheet.

In a conventional radiographic intensifying screen, in order to strengthen binding between a support and a fluorescent substance layer and in order to improve sensitivity or image quality (sharpness and graininess) as the radiographic intensifying screen, it is known to coat a polymer substance such as gelatin as an adhesive layer on the surface of a support on the side of the fluorescent substance layer or to provide thereon a light-reflection layer comprising a light-reflective substance such as titanium dioxide or a light-absorption layer comprising a light-absorptive substance such as carbon black. The support used in the present invention may be provided with each of the above-mentioned layer. The constitution may be arbitrarily selected depending upon the purpose and application of the desired radiographic intensifying screen. The fluorescent substance sheet obtained through step a) is loaded on a support. Next, the fluorescent substance sheet is stuck on the support while compressing it at a softening temperature or a melting point or higher of the binder.

In the above-mentioned manner, by the use of a method that compress the fluorescent substance sheet without fixing it on the support in advance, the sheet can be spread thinly. Accordingly, it prevents damage of the fluorescent substance. In addition, compared to a case wherein the sheet is fixed for being pressed, a higher fluorescent substance filling rate can be obtained even with the same pressure. Examples of a compressor used for compressing processing of the present invention include conventional ones such as a calendar roll and a hot press. In compression processing by the use of the calendar roll, the fluorescent substance sheet obtained through step a) is loaded on the support, and then, the sheet is passed through rollers heated to the softening temperature or the melting point of the binder or higher at a certain speed. However, a compressor used for the present invention is not limited thereto. Any compressing means can be used, provided that it can compress the sheet while heating it. The compression pressure is preferably 50 kg/cm$^2$ or more.

In an ordinary radiographic intensifying screen, a transparent protective layer is provided for protecting the fluorescent substance layer physically and chemically on the surface of the fluorescent substance layer opposite to that being in contact with the support, as described before. Such a protective layer is preferably provided in the radiographic intensifying screen of the present invention. Layer thickness of the protective layer is ordinarily in a range from about 0.1 to 20 μm. The transparent protective layer can be formed by a method that coats a solution prepared by dissolving a transparent polymer such as cellulose derivatives including cellulose acetate and nitro cellulose; and a synthetic polymer including polymethyl methacrylate, polyvinyl butylal, polyvinyl formal, polycarbonate, polyvinyl acetate, vinyl chloride-vinyl acetate copolymer on the surface of the fluorescent substance layer. In addition, the transparent protective layer can also be formed by a method that forms a sheet for forming a protective layer such as a plastic sheet composed of polyethylene terephthalate, polyethylene naphthalate, polyethylene, polyvinylidene chloride or polyamide; and a protective layer forming sheet such as a transparent glass plate is formed separately and they are stuck on the surface of the fluorescent substance layer by the use of an appropriate adhesive agent.

As a protective layer used for the radiographic intensifying screen of the present invention, a layer formed by a coating layer containing an organic solvent soluble fluorescent resin is preferable. As a fluorescent resin, a polymer of a fluorine-containing olefin (fluoro olefin) or a copolymer of a fluorine-containing olefin is cited. A layer formed by a fluorine resin coating layer may be cross-linked. When a protective layer composed of a fluorine resin is provided, dirt exuded from a film in contacting with other materials and an X-ray film is difficult to come into inside of the protective layer. Therefore, it has an advantage that it is easy to remove dirt by wiping. When an organic solvent soluble fluorescent resin is used as a material for forming a protective layer, it can be formed easily by coating a solution prepared by dissolving this resin in a suitable solvent and drying it. Namely, the protective layer is formed by coating the protective layer forming material coating solution containing the organic solvent soluble fluorine resin on the surface of fluorescent layer uniformly by the use of the doctor blade and by drying it. This formation of a protective layer may be conducted concurrently with the formation of the fluorescent substance layer by the use of multilayer coating.

The fluorine resin is a homopolymer or copolymer of a fluorine containing olefin (fluoroolefin). Its examples include polytetrafluoroethylene, polychlorotrifluoroethylene, polyvinyl fluoride, polyvinylidene fluoride, tetrafluoroethylene-hexafluoropropylene copolymer and fluoroolefin-vinyl ether copolymer. Though fluorine resins are insoluble in an organic solvent, copolymers of fluoroolefins as a copolymer component are soluble in an organic solvent depending upon other constituting units (other than fluoroolefin) of the copolymers. Therefore, the protective layer can be formed easily by coating a solution wherein the aforesaid resin is dissolved in a suitable solvent for preparing on the fluorescent substance layer to be dried. Examples of the above-mentioned copolymers include fluoroolefin-vinyl ether copolymer. In addition, polytetrafluoroethylene and its denatured product are soluble in a suitable fluorine-containing organic solvent such as a perfluoro solvent. Therefore, they can form a protective layer in the same manner as in the copolymer containing the above-mentioned fluoroolefin as a copolymer component.

To the protective layer, resins other than the fluorine resin may be incorporated. A cross-linking agent, a hardener and an anti-yellowing agent may be incorporated. However, in order to attain the above-mentioned object sufficiently, the content of the fluorine resin in the protective layer is suitably 30 wt % or more, preferably 50 wt % or more and more preferably 70 wt % or more. Examples of resin incorporated in the protective layer other than the fluorine resin include a polyurethane resin, a polyacrylic resin, a cellulose derivative, polymethylmethacrylate, a polyester resin and an epoxy resin.

The protective layer for the radiographic intensifying screen used in the present invention may be formed by either of an oligomer containing a polysiloxane skeleton or an oligomer containing a perfluoroalkyl group or by both thereof. The oligomer containing the polysiloxane skeleton has, for example, a dimethyl polysiloxane skeleton. It is preferable to have at least one functional group (for example, a hydroxyl group). In addition, the molecular weight (weight average) is preferably in a range from 500 to 100000, more preferably 1000 to 100000, especially more preferably 3000 to 10000. In addition, the oligomer containing the perfluoroalkyl group (for example, a tetrafluoroethylene group) preferably contains at least one functional group (for example, a hydroxyl group: -OH) in a molecule. Its molecular weight (weight average) is 500 to 100000, more preferably 1000 to 100000 and especially preferably 10000 to 100000. When an oligomer containing a functional group is used, cross-linking reaction occurs between the oligomer and a resin for forming a protective layer in forming the protective layer so that the oligomer is taken into a molecule structure of the layer-forming resin. Therefore, even when the X-ray conversion panel is used for a long time repeatedly or cleaning operation of the surface of the protective layer is carried out, the oligomer is not taken off from the protective layer. Therefore, the addition of the oligomer becomes effective for a long time so that use of the oligomer having a functional group becomes advantageous. The oligomer is contained in the protective layer preferably in an amount of 0.0 to 10 wt % and especially 0.1 to 2 wt %.

In the protective layer, perfluoro olefin resin powder or silicone resin powder may be added. As the perfluoro olefin resin powder or the silicone resin powder, those having an average particle size of preferably 0.1 to 10 μm, and more preferably 0.3 to 5 μm. The above-mentioned perfluoro olefin resin powder or the silicone resin powder is added to the protective layer preferably in an amount of 0.5 to 30 wt % and more preferably 2 to 20 wt % and especially preferably 5 to 15 wt %.

The protective layer of the intensifying screen is preferably a transparent synthetic resin layer coated on the fluorescent substance layer and having a thickness of 5 μm or less. The use of a thick protective layer leads to shorten the distance between the intensifying screen and a silver halide emulsion and therefore enhance sharpness of the resulting X-ray photographic image.

A filling ration of the fluorescent as defined in the present invention can be determined from a ratio of the void in the fluorescent substance layer coated on the support, according to the following equation.

$$Vair/V = \frac{(a+b)pxpyV - A(apx+bpy)}{V[(a+b)pxpy - apypair - bpxpair]} \quad \text{Equation (1)}$$

wherein

V; total volume of fluorescent substance layer

Vair; volume of air in fluorescent substance

A; total weight of fluorescent substance px; density of fluorescent substance py; density of binder pair; density of air a; weight of fluorescent substance b; weight of binder.

In the above equation, since "pair" is nearly zero, the equation (1) is approximately represented by the following equation (2).

$$Vair/V = \frac{(a+b)pxpyV - A(apx+bpy)}{V[(a+b)pxpy]} \quad \text{Equation (2)}$$

In the above, the definition of V, Vair, px, py, A, a and b is the same as that in (1). In the invention, the ratio of the void was determined from equation (2). The ratio of the void of the fluorescent substance can be determined from the following equation (3).

$$\frac{Aapx}{V[(a+b)pxpy]} \quad \text{Equation (3)}$$

In the above, the definition of V, Vair, px, py, A, a and b is the same as that in (1).

The intensifying screen according to the invention is preferably used in a combination of a intensifying screen (A) capable of absorbing not less than 40% of X-ray with an X-ray energy of 80 kVp and a intensifying screen (B) capable of absorbing not less than 50%, wherein (B) is larger in an absorbing amount than (A). The absorbing amount of the intensifying screen can be measured by the following method.

The X-ray which is produced from a tungsten target tube at 80 kVp by three phase power supply is allowed to transmit through an aluminum plate with a thickness of 3 mm and reach an intensifying screen fixed at the position of 200 cm farther from the tungsten anode of the target tube. Subsequently, the amount of X-ray which is transmitted through the intensifying screen is measure at the position of 50 cm behind the screen by a ionization dosimeter.

The thickness of the intensifying screen is within the range of 125 to 200 μm, in which the void ratio of the fluorescent substance is 65% or more.

The intensifying screen used in the present invention is prepared in accordance with the method described in JP-A 6-75097. The fluorescent substance is coated by the multilayer coating method so that larger particles are arranged near the surface protective layer.

Processing

The photographic material of the invention is processed by use of processing solutions described in RD-17643, XX–XXI, pages 29–30 and RD-308119, XX–XXI, pages 1011–1012.

Dihydroxybenzenes such as hydroquinone, 3-pyrazolidones such as 1-phenyl-3-pyrazolidone and aminophenols such as N-methyl-aminophenol are used singly or in combination thereof, as a developing agent used in black-and-white photography. A developing solution may optionally contain a preserver, alkali agent, pH buffering agent, antifoggant, hardener, development accelerating agent, surfactant, defoamer, toning agent, water-softener, dissolving aid or thickener.

A fixing agent such as a thiosulfate or thiocyanate is used in a fixer. Further, a water soluble aluminum salt such as aluminum sulfate or potassium alum may be contained as a hardener. In addition, preserver, pH-adjusting agent, water-softener may be contained.

Solid processing composition

In an automatic processor used in the invention which has mechanism of supplying a solid processing composition to a processing bath, known methods disclosed in Japanese Utility Model open to public inspection (OPI) publication 63-137783, 63-97522 and 1-85732 are available as a supplying means, in the case of the solid processing composition in a tablet form. If at least function for supplying the tablet to a processing bath is provided, any method may be usable. In the case of a solid processing composition in the form of granules or powder, gravity drop system described in Japanese Utility Model OPI publication 62-81964, 63-84151 and 1-292375, and screw-driving system described in Japanese Utility Model OPI publication 63-105159 and 63-195345 are known methods, but the present invention is not limited to these methods. The solid processing composition may be dropped in any portion of a processing bath. It is preferably the portion which is connected to a processing section and in which a processing solution flows to the processing portion. It is more preferably a structure in which a given amount of the processing solution circulates between the connected portion and the processing section and dissolved components are transferred to the processing section. The solid processing composition is preferably dropped into a temperature-controlled processing solution.

Dihydroxybenzenes described in Japanese Patent Application 4-286232 (pages 19–20), aminophenols, pyrazolidones and reductones are usable, as a developing agent, in a developer used in a processing method relating to the present invention. Among the pyrazolidones are preferred those substituted at the 4-position (Dimezone, Dimezone-S), which are water soluble and superior in storage stability when used in the form of the solid composition.

As a preservative is usable an organic reducing agent as well as sulfites described in Japanese Patent Application No. 4-286232. In addition, a chelating agent and bisulfite adduct described in Japanese Patent Application No. 4-586323 (on page 20 and 21, respectively) are usable. As a antisludging agent is usable a compound described in Japanese Patent Application No. 5-96115 (general formulas [4-a] and [4-b]). Cyclodextrin compounds are preferably used, as described in JP-A 1-124853. An amine compound, particularly as described in U.S. Pat. No. 4,269,929 may be added to a developing solution.

It is necessary to use a buffering agent in a developing solution. Examples of the buffering agent include sodium carbonate, potassium carbonate, sodium bicarbonate, potassium bicarbonate, trisodium phosphate, disodium phosphate, sodium borate, potassium borate, sodium o-hydroxybenzoate (sodium salicylate), potassium o-hydroxybenzoate, sodium 5-sulfo-2-hydroxybenzoate (sodium 5-sulfosalicylate), sodium 5-sulfo-2-hydroxybenzoate (sodium 5-sulfosalicylate).

As a development accelerating agent are cited thioether compounds described in Japanese Patent examined 37-16088, 37-5987, 38-7826, 44-12380, 45-9019 and U.S. Pat. No. 3,813,247; p-phenylenediamine compounds described in JP-A 52-49828, 50-15554; quaternary ammonium salts described in Japanese Patent examined 44-30074, JP-A 50-137726, 52-43429 and 56-156826; p-aminophenols described in U.S. Pat. Nos. 2,610,122 and 4,119,462; amine compounds described in U.S. Pat. Nos. 2,482,546, 2,494,903, 2,596,926, 3,128,182, 3,582,346 4,230,796, 3,253,919; polyalkylene compounds described in Japanese Patent 37-16088, 41-11431, 42-23883, 42-25201, U.S. Pat. Nos. 3,128,183, 3,532,501; 1-phenyl-3-pyrazolidones; hydrazines; mesoion type compound and imidazoles.

Alkali metal halides such as potassium iodide are used as a antifoggant. Organic antifoggants include benzotriazole, 6-nitrobenzimidazole, 5-nitrobenzimidazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolizine, adenine and 1-pheny-5-mercaptotetrazole.

Further, methylcellosolve, methanol, acetone, dimethylformamide, cyclodetrine compounds or compounds described in Japanese Patent examined 47-33378 and 44-9509 can be used as a solvent for increasing a solubility of a developing agent. Furthermore, various additives such as an antistaining agent, antisludging agent and interlayer effect-accelerating compound are optionally added.

A fixing agent, chelating agent, pH buffering agent, hardening agent and preservative known in the art can be added into a fixing solution, as described JP-A 4-242246 and 5-113632. A chelating agent, as a hardener or a bisulfite adduct of a hardener, as described in Japanese Patent Application 4-586323 is also usable in the fixing solution.

It is preferred to add a starter prior to processing. A solidified starter is also preferred. An organic acid such as polycarboxylic acid compound, alkali earth metal halide, organic restrainer or development accelerator is used as a starter.

According to the processing applicable to the present invention, the silver halide photographic light sensitive material is processed within a total processing time of 10 to 45 sec. and preferably 15 to 30 sec. The total processing time refers to the process of from developing to drying being completed with 45 sec. by using an automatic processor. Thus, a period of from the time of the top of the photographic material being dipped into a developer to the time of the top coming out from the drying zone (i.e., Dry to Dry time) is within 45 sec.

Drying is conducted at a temperature 35 to 100, preferably 40° to 80° C. by blowing hot-air. A drying zone by a far-infrared heating means may be provided with the processor. There may be used an automatic processor in which a mechanism of providing water or acidic rinsing solution between a developing bath and a fixing bath or the fixing bath and a washing bath, as disclosed in JP-A 3-264953. A device for preparing a developer or fixer may be built therein. The photographic material may be processed with conventional processing solutions without use of solid processing composition.

The photographic material of the invention can be processed with a developer and/or developer replenishing solution containing a compound represented by formula (A), using an automatic processor.

Formula (A)

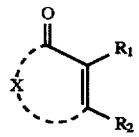

The compound may be added to a developer in an amount of 0.005 to 0.5, preferably 0.02 to 0.4 mol per liter of the developer.

in the formula, $R_1$ and $R_2$ each represent a hydroxy group, amino group, acylamino group, alkylsulfonylamino group, arylsulfonylamino group, alkoxycarbonylamino group, mercapto group and alkylthio group; X represents a group of atoms necessary for forming a ring, preferably comprised of carbon atom, oxygen atom or nitrogen atom. The ring is 5 or 6-membered one including two vinyl carbon substituted by $R_1$ and $R_2$, and carbonyl carbon. Concretely, $R_1$ and $R_2$ independently represent a hydroxy group, amino group (which may be substituted by an alkyl group having 1 to 10 carbon atoms such as methyl, ethyl, n-butyl or hydroxyethyl), acylamino group (i.e., acetyl amino, benzoylamino, etc.); alkylsulfonylamino group (benzenesulfonylamino, p-toluenesulfonylamino, etc.); alkoxycarbonylamino group (methoxycarbonylamino group etc.); mercapto group; alkylthio group (methylthio, ethylthio etc.). As preferred examples of $R_1$ and $R_2$ are cited a hydroxy group, amino group, alkylsulfonylamino group and arylsulfonylamino group. X is a 5- or 6-membered ring, preferably comprised of a carbon atom, oxygen atom or nitrogen atom. Thus, X is comprised of a combination of —O—, —C($r_3$)($R_4$)—, —C($R_5$)=, —C(=O)—, —N($R_6$)—, and —N=, in which $R_3$, $R_4$, $R_5$ and $R_6$ independently represent a hydrogen atom, alkyl group having 1 to 10 carbon atoms (which may be substituted by a hydroxy, carboxy or sulfo group), aryl group having 6 to 15 carbon atoms (which may be substituted by an alkyl group, halogen atom, hydroxy, carboxy or sulfo group), hydroxy group or carboxy group. The 5- or 6-membered ring includes saturated or unsaturated condensed ring. Examples of the 5- or 6-membered ring include a dihydrofuranone ring, dihydropyrrone ring, pyranone ring, cyclopentenone ring, cyclohexenone ring, pyrrolinone ring, pyrazolinone ring, pyridone ring, azacyclohexenone ring, and uracil ring. Among these are preferred a dihydrofuranone ring, cyclopentenone ring, cyclohexenone ring, pyrazolinone ring, azacyclohexenone ring and uracil ring. Examples of the compounds represented by formula (A) are shown as below, but the present invention is not limited thereto.

A-1

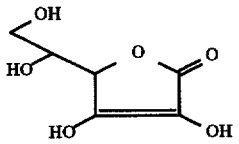

A-2

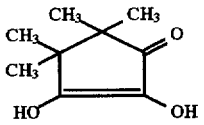

A-3

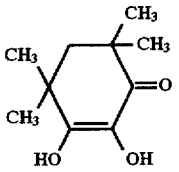

A-4

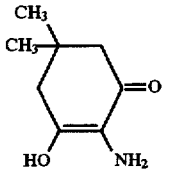

A-5

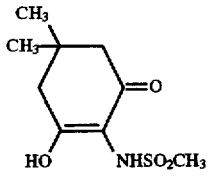

A-6

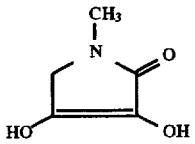

-continued

A-7

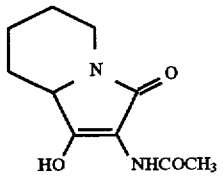

A-8

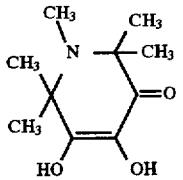

A-9

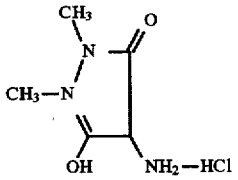

A-10

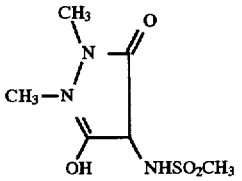

A-11

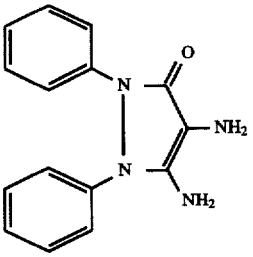

A-12

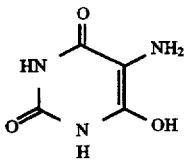

A-13

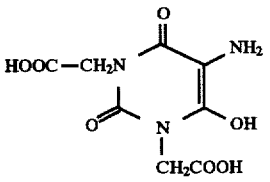

A-14

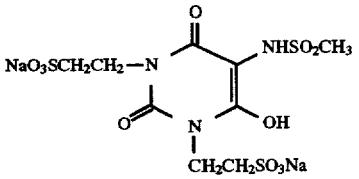

-continued

A-15

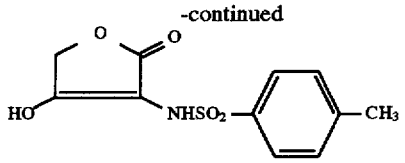

A-16

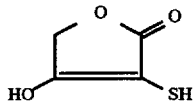

A-17

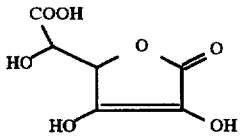

A-18

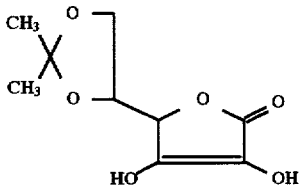

A-19

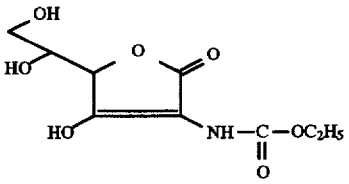

A-20

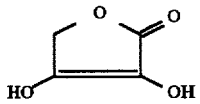

A-21

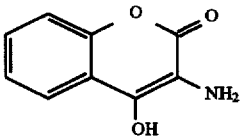

A-22

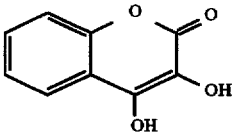

Processing time

In the present invention, there can be achieved super-rapid processing within a total processing time (Dry to Dry) of 25 sec. The "developing process time" or "developing time" in the invention refers to a period of from the time when the top of a photographic material is dipped in a developer tank solution of an automatic processor to the time when the top is dipped in a fixer tank solution; the "fixing time" refers to a period of from the time of being dipped in a fixer tank solution to the time of being dipped in the next washer (or stabilizer) tank solution; and the "washing time" refers to a period of time of being dipped in a washer tank solution. The processor is conventionally provided with a drying zone by impingement of hot-air with a temperature of 35 to 100, preferably 40° to 80° C. The "drying time" refers to a period of time of being in the drying zone. In the processing relating to the invention, the developing time is 3 to 15, preferably 3 to 10 sec. at a temperature of 25 to 50, preferably 30° to 40° C. The fixing temperature and time each are preferably 20° to 50° C. and 2 to 12 sec., more preferably 30° to 40° C. and 2 to 10 sec. The washing or stabilizing time each are preferably 0° to 50° C. and 2 to 15 sec., more preferably, 15° to 40° C. and 2 to 8 sec. According to the invention, developed, fixed and washed (or stabilized) photographic material is squeezed through squeegee rollers and then dried. The drying is carried out at a temperature of 40° to 100° C. and the drying time is optimally variable, depending on an environment temperature. The drying time is conventionally 3 to 12 sec., preferably 3 to 8 sec. at 40° to 80° C. It is also preferred to employ a far-infrared heater.

Replenishing rate

In the invention, the photographic material can be processed at a replenishing rate of a developer or fixer of not more than 200 ml per $m^2$ of the material.

Furthermore, various techniques employed in the art are applicable to embodiment of the invention.

EXAMPLES

Embodiments of the present invention will be Explained as below, but the invention is not limited to these example.

Example 1

Preparation of silver bromochloride emulsion

Preparation of silver chloride tabular seed grain emulsion

Solution A1:

| | |
|---|---|
| Ossein gelatin | 37.5 g |
| KI | 0.625 g |
| NaCl | 16.5 g |
| Exemplified compound 2-2 (p = 17, n + m = 5–7) 10% methanol solution | Amount as shown in Table 1 |
| Potassium hexechloroiridate | Amount as shown in Table 1 |
| Distilled water to make | 7500 ml |

| | |
|---|---|
| Silver nitrate | 1500 g |
| Distilled water to make | 2500 ml |

| | |
|---|---|
| KI | 4 g |
| NaCl | 140 g |
| Distilled water to make | 684 ml |

| | |
|---|---|
| NaCl | 375 g |
| Distilled water to make | 1816 ml |

To Solution A1 at 40° C. in a stirring vessel as described in Japanese Patent examined 58-58288 and 58-58289 were added 684 ml of Solution B1 and a total amount of Solution C1 over a period of 1 min. The EAg was adjusted to 149 mV and the emulsion was subjected to Ostwald-ripening for 20 min. Thereafter, the residual amount of solution B1 and Solution D1 were added over a period of 40 min., while being maintained at a EAg of 149 mV.

After completing the addition, the resulting emulsion was subjected to coagulation desalting to remove soluble salts, according to the following procedure.

(1) To a reaction solution, after completing the addition, was added 20 g/mol AgX of a coagulating agent, G-3 exemplified in JP-A 2-7037, and the pH was adjusted to 4.30 with 56 wt % acetic acid. After being allowed to stand, the supernatant solution was decanted.

(2) Water with a temperature at 40° C. of 1.8 l/mol AgX was added thereto and after mixing for 10 min., the emulsion was allowed to stand and the supernatant was decanted.

(3) The procedure of (2) above-described was repeated further once more.

(4) After-gelatin of 15 g/mol AgX, sodium carbonate and water were added thereto. The pH was adjusted to 6.0 and the final amount was made to 450 ml/mol AgX.

Thus-prepared seed emulsions EM-A to EM-E were observed with an electronmicroscope with respect to ca. 3,000 grains of each emulsion to determine the shape of the resulting grains. Results thereof are shown in Table 1.

TABLE 1

| Seed emulsion | Compd 2-2 (ml) | Iridate (mg) | Tabular grains with (100) major faces: Ratio (%) *1 | Size (μm) *2 | Thickness (μm) *3 | V.C. (%) *4 |
|---|---|---|---|---|---|---|
| EM-A | 0 | 0 | 60 | 0.5 | 0.07 | 25 |
| EM-B | 0 | 14 | 70 | 0.5 | 0.07 | 27 |
| EM-C | 0.5 | 0 | 80 | 0.5 | 0.07 | 17 |
| EM-D | 5 | 0 | 83 | 0.5 | 0.07 | 15 |
| EM-E | 0.5 | 14 | 87 | 0.5 | 0.07 | 16 |

*1: Percentage of grain protected area accounted for by tabular grains
*2: Average grain size
*3: Average grain thickness
*4: Variation coefficient of grain size Preparation of silver chloride tabular grain emulsion Using the following solutions, a tabular silver chloride emulsion was prepared.

Solution A2

| | |
|---|---|
| Ossein gelatin | 29.4 g |
| Exemplified compound 2-2 (p = 17, n + m = 5–7) 10% methanol solution | 1.25 ml |
| Seed emulsion | Amount as shown in Table 2 |
| Distilled water to make | 3000 ml |

Solution B2

| | |
|---|---|
| 3.50N $AgNO_3$ aq. solution | 2240 ml |

Solution C2

| | |
|---|---|
| NaCl | 455 g |
| Distilled water to make | 2240 ml |

Solution D2

1.75N NaCl aq. solution for adjusting EAg

To Solution A2 maintained at 40° C. were added with stirring by double jet addition at an accelerated flow rate (3×from the start to finish-i.e., 3 times faster at the end than at the start) Solutions B2 and C2 over a period of 110 min. to cause the seed grains to grow.

During the addition, the silver potential (EAg) was controlled to be +210 mV using Solution D2.

After the completion of the addition, the resulting emulsion was subjected to coagulation desalting to remove soluble salts in a manner similar to the seed emulsion.

Thus-prepared emulsions EM-1 to EM-5 were observed with an electronmicroscope with respect to ca. 3,000 grains of each emulsion to determine the shape of the resulting grains. Results thereof are shown in Table 2.

Preparation of tabular silver bromochloride ($AgBr_{0.45}Cl_{0.55}$) emulsion

Using the following solutions, a silver bromochloride tabular grain emulsion was prepared.

| | |
|---|---|
| Ossein gelatin | 29.4 g |
| Exemplified compound 2-2 (p = 17, n + m = 5–7) 10% methanol solution | 1.25 ml |
| Seed emulsion | Amount as shown in Table 2 |
| Distilled water to make | 3000 ml |

Solution B3

| | |
|---|---|
| 3.50N $AgNO_3$ aq. solution | 2240 ml |

Solution C3

| | |
|---|---|
| NaCl | 250 g |
| KBr | 420 g |
| Distilled water to make | 2240 ml |

Solution D3

1.75N NaCl aq. solution for adjusting EAg

To Solution A3 maintained at 55° C. were added with stirring by double jet addition at an accelerated flow rate (3×from the start to finish—i.e., 3 times faster at the end than at the start) Solutions B3 and C3 over a period of 130 min. to cause the seed grains to grow.

During the addition, the silver potential (EAg) was controlled to be +210 mV using Solution D3.

After the completion of the addition, the resulting emulsion was subjected to coagulation desalting to remove soluble salts in a manner similar to the seed emulsion.

Thus-prepared emulsions EM-6 to EM-10 were observed with an electronmicroscope with respect to ca. 3,000 grains of each emulsion to determine the shape of the resulting grains. Results thereof are shown in Table 2.

Preparation of tabular silver bromochloride ($AgBr_{0.7}Cl_{0.3}$) emulsion

Using the following solutions, a silver bromochloride tabular grain emulsion was prepared.

Solution A4

| | |
|---|---|
| Ossein gelatin | 29.4 g |
| Exemplified compound 2-2 (p = 17, n + m = 5 – 7) 10% methanol solution | 1.25 ml |
| Seed emulsion | Amount as shown in Table 2 |
| Distilled water to make | 3000 ml |

Solution B4

| | |
|---|---|
| 3.50N $AgNO_3$ aq. solution | 2240 ml |

Solution C4

| | |
|---|---|
| NaCl | 137 g |
| KBr | 653 g |
| Distilled water to make | 2240 ml |

Solution D3

1.75N NaCl aq. solution for adjusting EAg

To Solution A4 maintained at 55° C. were added with stirring by double jet addition at an accelerated flow rate (3×from the start to finish—i.e., 3 times faster at the end than at the start) Solutions B4 and C4 over a period of 130 min. to cause the seed grains to grow.

During the addition, the silver potential (EAg) was controlled to be +210 mV using Solution D4.

After the completion of the addition, the resulting emulsion was subjected to coagulation desalting to remove soluble salts in a manner similar to the seed emulsion.

Thus-prepared emulsions EM-6 to EM-10 were observed with an electronmicroscope with respect to ca. 3,000 grains of each emulsion to determine the shape of the resulting grains. Results thereof are shown in Table 2.

Thus prepared emulsion are shown in Table 2.

TABLE 2

| | | | | Tabular grains with (100) major faces | | | |
|---|---|---|---|---|---|---|---|
| Emulsion No. | AgCl Content *5 | Seed emulsion No. | Seed emulsion (mol) | Ratio (%) *1 | Size (μm) *2 | Thickness (μm) *3 | V.C. (%) *4 |
| EM-1 | 100 | EM-A | 0.98 | 65 | 1.00 | 0.14 | 25 |
| EM-2 | 100 | EM-B | 0.98 | 72 | 1.00 | 0.14 | 30 |
| EM-3 | 100 | EM-C | 0.98 | 85 | 1.00 | 0.14 | 18 |
| EM-4 | 100 | EM-D | 0.98 | 88 | 1.00 | 0.14 | 16 |
| EM-5 | 100 | EM-E | 0.98 | 92 | 1.00 | 0.14 | 17 |
| EM-6 | 55 | EM-A | 0.98 | 62 | 0.98 | 0.16 | 25 |
| EM-7 | 55 | EM-B | 0.98 | 70 | 0.98 | 0.16 | 28 |
| EM-8 | 55 | EM-C | 0.98 | 82 | 0.98 | 0.16 | 17 |
| EM-9 | 55 | EM-D | 0.98 | 85 | 0.98 | 0.16 | 15 |
| EM-10 | 55 | EM-E | 0.98 | 90 | 0.98 | 0.16 | 16 |
| EM-11 | 30 | EM-A | 0.98 | 61 | 0.96 | 0.17 | 25 |
| EM-12 | 30 | EM-B | 0.98 | 68 | 0.96 | 0.17 | 28 |
| EM-13 | 30 | EM-C | 0.98 | 81 | 0.96 | 0.17 | 17 |
| EM-14 | 30 | EM-D | 0.98 | 84 | 0.96 | 0.17 | 15 |
| EM-15 | 30 | EM-E | 0.98 | 88 | 0.96 | 0.17 | 16 |

*1: Percentage of grain projected area accounted for by tabular grains
*2: Average grain size
*3: Average grain thickness
*4: Variation coefficient of grain size
*5: Chloride content of silver halide formed on seed grains (mol %)

As can be seen from Table 2, in a silver halide emulsion prepared according to the present invention, tabular grains with {100} major faces accounted for high percentage of the grain projected area ratio and were small in variation coefficient of grain size.

Preparation of silver iodide fine grain emulsion

Solution A5

| | |
|---|---|
| Ossein gelatin | 100 g |
| KI | 8.5 g |
| Distilled water to make | 2000 ml |

Solution B5

| | |
|---|---|
| $AgNO_3$ | 360 g |
| Distilled water to make | 605 ml |

Solution C5

| | |
|---|---|
| KI | 352 g |
| Distilled water to make | 605 ml |

To a reaction vessel was added Solution A5 and thereto were further added with stirring at 40° C. by double jet addition Solutions B5 and C5 at a constant flow rate over a period of 30 min.

During the addition, the pAg was maintained at 13.5 by means of a conventional pAg controller. The resulting silver iodide was proved to comprised of fine grains with an average size of 0.06 μm and a mixture of β-AgI and γ-AgI.

This emulsion was referred to as silver iodide fine grain emulsion.

Preparation of solid particle dispersion of sensitizing dye

The following spectral sensitizing dyes (A) and (B) were added in a ratio of 100:1 to water maintained at 27° C. and stirred at a speed of 3,500 rpm with a high speed dissolver for a period of 30 to 120 min. to obtain a solid particle dispersion of the spectral sensitizing dyes. The concentration of the dye (A) was 2%.

Sensitizing dye (A): 5,5'-Dichloro-9-ethyl-3,3'-di-(3-sulfopropyl)oxacarbocyanine disodium salt anhydride Sensitizing dye (B): 5,5'-Di-(butoxycarbonyl)-1,1'-diethyl-3,3'-di-(4-sulfobutyl)benzimidazolocarbocyanine sodium salt anhydride Sensitization The resulting emulsions were further subjected to spectral sensitization and chemical sensitization in the following manner. To the emulsion at 50° C. were the sensitizing dyes (A) and (B) in the form of a solid particle dispersion; and then a mixture solution of ammonium thiocyanate, chloroauric acid and sodium thiosulfate, and adenine were added thereto. Further thereto were added a dispersion of triphenyl phosphine selenide and a silver iodide fine grain emulsion and the emulsion was ripened over a period of 2 hr 30 min. at the time when completing the ripening, 4-hydroxy-6-methyl-1,3,3a,7-tetrazaindene (TAI) was added, as a stabilizer, in an optimal amount.

The addition amount of the sensitizing dye and other additives (per mol of AgX) were as follows.

| | |
|---|---|
| Spectral sensitizing dye (A) | 400 mg |
| Spectral sensitizing dye (B) | 4 mg |
| Adenine | 10 mg |
| Ammonium thiocyanate | 3.3 mg |
| Chloroauric acid | 50 mg |
| Sodium thiosulfate | 2.0 mg |
| Triphenylphosphine selenide | 4.0 mg |
| Silver iodide fine grains | 5 mmol equivalent |
| Stabilizer (TAI) | 1000 mg |

A dispersion of selenium sensitizer above described was prepared in the following manner. Triphenyl phosphine selenide o 120 g was dissolved, with stirring, in 30 kg of acetic acid at 50° C. Photographic gelatin of 3.8 kg was dissolved in water of 38 kg and thereto was added 93 g of an aqueous 25 wt. % solution of sodium dodecylbenzenesulfonate. Subsequently, these two solutions were mixed and dispersed with a high speed stirring-type dispersing machine provided with a dissolver having a diameter of 10 cm at a dispersing blade-circulating speed of 40 m/sec. over a period of 30 min. The dispersion was stirred under reduced pressure to remove ethyl acetate until the residual concentration of ethyl acetate reached 0.3 wt. % or less. Thereafter, the dispersion was diluted to make 80 kg. A part of the resulting dispersion was used for the experiment above-described.

Preparation of samples

To each of the emulsions were added the following additives to prepare an emulsion coating solution. The addition amount is expressed in an amount per mol of silver halide.

| | |
|---|---|
| 1,1-Dimethylol-1-brom-1-nitromethane | 6 mg |
| t-Butyl-catechol | 57 mg |
| Polyvinyl pyrrolidone (M.W. 10,000) | 850 mg |
| Sodium polystylenesulfonate (M.W. 600,000) | 1.9 g |
| Nitrophenyl-triphenylphosphonium chloride | 14 mg |
| Ammonium 1,3-dihydroxybenzene-4-sulfonate | 1700 mg |
| Thallium nitrate | 57 mg |
| Potassium bromide | 170 mg |
| Colloidal silica (av. size 14 nm) | 33 mg |
| 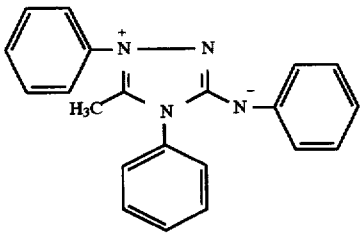 | 150 mg |
| 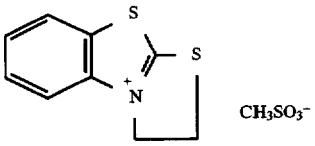 | 70 mg |
| 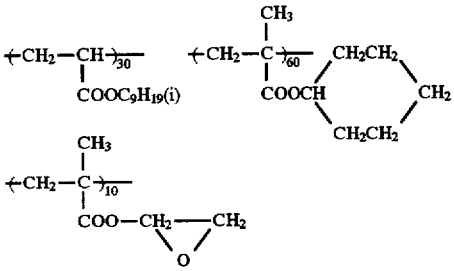 | 33 g |
| $n\text{-}C_4H_9OCH_2CH(OH)CH_2N(CH_2COOCH_3)_2$ | 710 mg |
| 1-Phenyl-5-mercaptotetrazole | 4 mg |

Additives used in a protective layer were as follows. The addition amount was expressed in per g of gelatin.

| | |
|---|---|
| Sodium i-amyl-n-decylsuccinate | 8.8 mg |
| Polymethyl methacrylate (matting agent area-averaged particle size of 0.35 μm) | 32 mg |
| $C_{12}H_{25}CONH(CH_2CH_2O)_5H$ | 56 mg |
| Hardener j | |
| 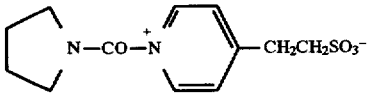 | 30 mg |
| 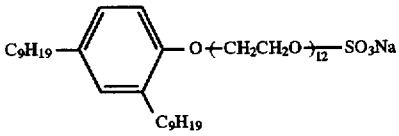 | 100 mg |
| 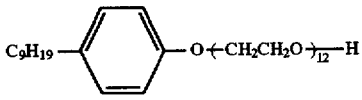 | 25 mg |

-continued

| | |
|---|---|
| 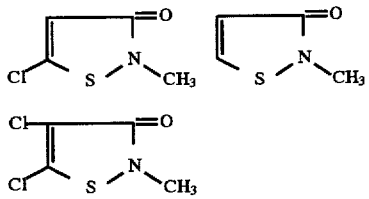 | 0.8 mg |

(Molar ratio, 50:46:4)

The above-described coating solutions each were coated on both sides of a subbed, blue-tinted polyethylene terephthalate film base and dried to prepare a photographic material sample. The silver coating weight was 1.8 g/m$^2$ per one side of the photographic material and the coating weight of gelatin for the protective layer and emulsion layer were 0.95 and 1.7 g/m$^2$, respectively.

Between the emulsion layer and the sublayer was provided a crossover cutting layer containing the following dye-dispersion of dye, 0.25 mg/m$^2$ with gelatin of 0.4 g/m$^2$.

Dye (A)

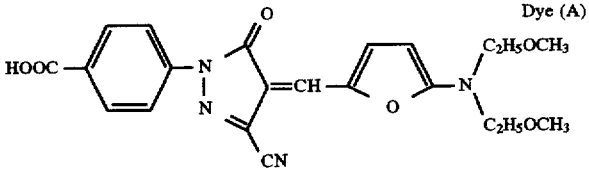

Dye dispersing method

To a ball mill vessel were added water and alkanol XC (alkylnaphthalene sulfonate produced by Du Pont), further thereto was added dye, and after putting in zirconium oxide beads to the vessel and sealing it, ball mill-dispersion was conducted for 4 days. Thereafter, a gelatin aqueous solution was added thereto to continue mixing for 10 min., and the beads were removed to obtain a coating solution.

Preparation of radiographic intensifying screen 1

| | |
|---|---|
| Fluorescent substance $Gd_2O_2S$:Tb (average particle size, 1.8 μm) | 200 g |
| Polyurethane type thermoplastic elastomer Deluxe TPKL-5-2625, solid component of 40% (product by Sumitomo Bayer Corp.) | 20 g |
| Nitrocellulose (nitration degree of 11.5%) | 2 g |

To the above was added methylethylketone as a solvent and the mixture was dispersed with a propeller type mixer to obtain a coating solution for fluorescent substance forming layer with a viscosity of 25 ps at 25° C.

Binder/Fluorescent substance=1/22

Separately, 90 g of soft type acryl resin, 50 g of nitrocellulose were added to methylethylketone to be dispersed to obtain a dispersion with a viscosity of 3 to 6 ps at 25° C., as a coating solution to form a sublayer.

A polyethylene terephthalate base (support) compounded with titanium dioxide and with a thickness of 250 μm was horizontally placed on a glass plate and thereon was uniformly coated the coating solution of the sublayer above-described by using a doctor blade. Thereafter, the coated layer was dried with slowly increasing a temperature from 25° to 100° C. to form the sublayer on the support. A thickness of the sublayer was 15 μm.

Further thereon was coated the coating solution of the fluorescent substance in a thickness of 240 μm by using a doctor blade and dried, and subjected to compression. The compression was conducted by means of a calendar roll at a pressure of 800 kgw/cm$^2$ and a temperature of 80° C. After compression, a transparent protective layer was formed in accordance with the method described in Example 1 of JP-A 6-75097. There was thus prepared radiographic intensifying screen 1 comprising a support, sublayer, fluorescent substance layer and transparent protective layer.

Preparation of radiographic intensifying screen 2

A radiographic intensifying screen 2 comprising a support, sublayer, fluorescent substance layer and transparent protective layer in the same manner as the intensifying screen 1, except that a coating solution of the fluorescent substance layer was coated in a thickness of 150 μm and the compression was not conducted. Measurement of characteristics of the intensifying screen Sensitivity A one-sided photographic material MRE, product by Eastman Kodak in contact with an objective intensifying screen was exposed to X-ray through a step wedge having a width of log E=0.15, with varying exposure by distance. Exposed photographic material were processed according to the method which will be described in measurement of characteristics of the photographic material.

Densitometry of the processed samples were made with visible light to obtain a characteristic curve. A sensitivity is expressed as a relative value of a reciprocal of X-ray exposure necessary for obtaining a density of Dmin plus 1.0, based on the sensitivity at the time when using intensifying screen 1 being 100 (standard value)

Amount of X-ray absorbed

The X-ray which is produced from a tungsten target tube at 80 kVp by three phase power supply is allowed to transmit through an aluminum plate with a thickness of 3 mm and reach an intensifying screen fixed at the position of 200 cm farther from the tungsten anode of the target tube. Subsequently, the amount of X-ray which is transmitted through the intensifying screen is measure at the position of 50 cm behind the screen by a ionization dosimeter.

Results of the above described evaluations are as follows.

| | X-ray | Fluorescent substance | | |
|---|---|---|---|---|
| Intensifying screen | absorbed amount (%) | Filling ratio (%) | Thickness (μm) | Sensitivity |
| 1 | 55 | 72 | 154 | 100 |
| 2 | 37 | 65 | 105 | 61 |

Sensitometric evaluation

A photographic material sample is sandwiched between the intensifying screens (1 or 2), exposed to X-ray through a penetrometer type B (product by Konica Medical), and processed with SR-DF processing solutions at 35° C. and SRX-503 automatic processor for a total processing time of 45 sec. (alternatively, denoted as "45 sec.-process"), wherein replenishing rates of developer and fixer were respectively 210 ml/m$^2$.

A sensitivity (alternatively, denoted as "S") was defined as a reciprocal of X-ray exposure necessary for giving a density of minimum density plus 1.0. The sensitivity was expressed as a relative vale, based on the sensitivity of sample 1 being 100.

Evaluation of super rapid processability

In a manner similar to the sensitometric evaluation, a photographic material sample was sandwiched between the intensifying screens (1), exposed to X-ray, and processed with SR-DF solutions at 35° C. and SRX-503 processor modified so as to process according to the following steps (alternatively, denoted as "15 sec.-process"). Replenishing rates of developer and fixer were respectively 125 ml/m$^2$.

| | |
|---|---|
| Developing time: | 4 sec. |
| Fixing time: | 3.1 sec. |
| Washing time: | 2 sec. |
| Between washing and drying (Squeegee): | 1.6 sec. |
| Drying time: | 4.3 sec. |
| Total processing time: | 15 sec. |

Variation in running processing with the processor was evaluated in the following manner. After continuously processing, with the processor and processing solutions above-described, 200 sheets of the photographic material sample with a size of 35.5×35.6 cm which were each exposed so as to give a density of about 1.0, exposed photographic material sample was similarly processed. Results with respect to the sensitivity and fog are shown in Table 3.

Evaluation of graininess

A photographic material in combination with an intensifying screen was subjected to exposure in such a manner that a chest phantom produced by Kyoto Kagaku was placed 140 cm apart from an X-ray source at 120 kVp provided with an aluminum equivalent filter with a thickness of 3mm and behind the phantom were further placed a grid for prevention of scattering having a grid ratio of 8:1, the intensifying screen and the photographic material in this order.

X-ray exposure was adjusted by varying exposure time so that a portion with a highest density of the lungs has a density of 1.8±0.5. Resulting photographs were visually evaluated with respect to graininess, based on the following criteria.

Evaluation criteria of graininess

A: Almost inconspicuous

B: Slightly conspicuous

C: Conspicuous, slightly difficult in reading

D: Very conspicuous, difficult in reading Results thereof are shown in Table 3

TABLE 3

| | | Intensifying screen 1 | | | | | Intensifying screen 2 | | | | | |
|---|---|---|---|---|---|---|---|---|---|---|---|---|
| Sample | Emulsion | 45 Sec-Process | | 15 Sec-Process | | | 45 Sec-Process | | 15 Sec-Process | | | |
| No. | No. | Fog | S | Fog | S | Graininess | Fog | S | Fog | S | Graininess | Remarks |
| 1 | EM-1 | 0.09 | 100 | 0.10 | 60 | C | 0.08 | 61 | 0.09 | 37 | C | Comp. |
| 2 | EM-2 | 0.09 | 105 | 0.10 | 62 | C | 0.08 | 64 | 0.09 | 38 | D | Comp. |
| 3 | EM-3 | 0.02 | 115 | 0.02 | 114 | B | 0.01 | 70 | 0.01 | 70 | B | Inv. |
| 4 | EM-4 | 0.02 | 115 | 0.02 | 114 | A | 0.01 | 70 | 0.01 | 70 | A | Inv. |

TABLE 3-continued

| Sample No. | Emulsion No. | Intensifying screen 1 45 Sec-Process Fog | S | 15 Sec-Process Fog | S | Graininess | Intensifying screen 2 45 Sec-Process Fog | S | 15 Sec-Process Fog | S | Graininess | Remarks |
|---|---|---|---|---|---|---|---|---|---|---|---|---|
| 5 | EM-5 | 0.02 | 120 | 0.02 | 119 | A | 0.01 | 73 | 0.01 | 73 | A | Inv. |
| 6 | EM-6 | 0.08 | 105 | 0.10 | 60 | C | 0.07 | 64 | 0.09 | 37 | C | Comp. |
| 7 | EM-7 | 0.08 | 110 | 0.10 | 65 | C | 0.07 | 67 | 0.09 | 40 | D | Comp. |
| 8 | EM-8 | 0.02 | 120 | 0.02 | 119 | A | 0.01 | 73 | 0.01 | 73 | A | Inv. |
| 9 | EM-9 | 0.02 | 120 | 0.02 | 119 | A | 0.01 | 73 | 0.01 | 73 | A | Inv. |
| 10 | EM-10 | 0.02 | 125 | 0.02 | 124 | A | 0.01 | 76 | 0.01 | 76 | A | Inv. |
| 11 | EM-11 | 0.08 | 107 | 0.09 | 62 | C | 0.07 | 65 | 0.08 | 38 | C | Comp. |
| 12 | EM-12 | 0.08 | 112 | 0.09 | 67 | C | 0.07 | 68 | 0.08 | 41 | D | Comp. |
| 13 | EM-13 | 0.02 | 125 | 0.02 | 124 | A | 0.01 | 76 | 0.01 | 76 | A | Inv. |
| 14 | EM-14 | 0.02 | 125 | 0.02 | 124 | A | 0.01 | 76 | 0.01 | 76 | A | Inv. |
| 15 | EM-15 | 0.02 | 130 | 0.02 | 129 | A | 0.01 | 79 | 0.01 | 79 | A | Inv. |

As can be seen from Table 3, inventive samples were excellent in sensitivity, fog and graininess and without any deterioration therein even when subjected to rapid-processing.

Example 2

Process-2: Processing by the use of a solid processing composition containing hydroquinone Solid processing compositions for use in replenishing developer were prepared according to the following operations (a) and (B).

Operation (A)

3000 g of hydroquinone, as a developing agent was ground into grain until an average grain size became 10 μm using a commercially available bandom mill. 3000 g of sodium sulfite, 200 g of potassium sulfite and 1000 g of Dimezone were added to this powder and mixed by the mill for 30 min. After granulating the mixture by adding 30 ml of water at room temperature for 10 min., the granulated product was dried for 2 hr. using a fluidized bed dryer at 40° C. to remove moisture contained almost completely. The thus prepared granules was mixed with 100 g of polyethylene glycol 6000 using a mixer for 10 min. in a room conditioned at 25° C. and 40% R.H. Thereafter, the mixture was subjected to compression-molding on a modified tabletting machine, Tough Press Collect 1527 HU, produced by Kikusui Manufacturing Co., Ltd. to prepare 2500 tablets (A) having a weight of 3.84 g per tablet, for use as developer-replenisher.

Operation (B)

100 g of DTPA, 4000 g of potassium carbonate, 10 g of 5-methylbenzotriazole, 7 g of 1-phenyl-5-mercaptotetrazole, 5 g of 2-mercaptohypoxanthine, 200 g of KOH and N-acetyl-D,L-penicillamine were ground to form granules in a similar manner to the operation (A). After granulation, the granules were dried at 50° C. for 30 min. to almost completely remove moisture contained. Thereafter, the mixture was subjected to compression-molding on a modified tabletting machine, Tough Press Collect 1527 HU, produced by Kikusui Manufacturing Co., Ltd. to prepare 2500 tablets (B) having a weight of 1.73 g per tablet, for use as developer-replenisher Tablets for use in fixer-replenishment were prepared according to the following operations.

Operation (C)

14000 g of a mixture of ammonium thiosulfate/sodium thiosulfate (70/30 by weight) and 1500 g of sodium sulfite were ground and mixed using commercially available mixing machine. Adding water of 500 ml, the mixture was granulated in a similar manner to the operation (A). After granulation, the granules were dried at 60° C. for 30 min. to almost completely remove moisture contained. Thereafter, 4 g of N-lauroylalanine was added thereto and the mixture was subjected to compression-molding on a modified tabletting machine, Tough Press Collect 1527 HU, produced by Kikusui Manufacturing Co., Ltd. to prepare 2500 tablets (A) having a weight of 6.202 g per tablet, for use as fixed-replenisher.

Operation (D)

1000 g of boric acid, 1500 g of aluminum sulfate 18 hydrate, 3000 g of sodium hydrogen acetate (equimolar mixture of glacial acetic acid and sodium acetate) and 200 g of tartaric acid were ground and mixed in a similar manner to the above operation (A). Adding water of 100 ml, the mixture was granulated in a similar manner to the operation (A). After granulation, the granules were dried at 50° C. for 30 min. to almost completely remove moisture contained. Thereafter, 4 g of N-lauroylalanine was added thereto and the mixture was subjected to compression-molding on a modified tabletting machine, Tough Press Collect 1527 HU, produced by Kikusui Manufacturing Co., Ltd. to prepare 1250 tablets (B) having a weight of 4.562 g per tablet, for use as fixed-replenisher.

Starter

| | |
|---|---|
| Glacial acetic acid | 2.98 g |
| KBr | 4.0 g |
| Water to make | 1 liter |

At the start of processing, tablets for developer were dissolved in water to prepare a developer and 330 ml of the starter was added to 16.5 l of the developer to prepare a starting developer solution. The start solution was introduced in a developer bath and processing was started. The pH of the developer solution was 10.45.

Photographic materials prepared in Example 1 were exposed so as to give a density of 1.0 and subjected to running-processing. Processing was carried out using an automatic processor, SRX-502, which was provided with a input member of a solid processing composition and modified so as to complete processing in 15 sec. During running-processing, to the developer solution were added tablets (A) and (B), each 2 tablets and 76 ml of water per 0.62 $m^2$ of the photographic material. When each of the tablets (A) and (B) was dissolved in water of 38 ml, the pH was 10.70. To the fixer solution were added 2 tablets of (C) and 1 tablet of (D) per 0.62 $m^2$ with 74 ml of water. Addition of water was started at the same time of that of the tablets and continued at a constant rate further for 10 min. in proportion to a dissolving rate of the solid processing composition.

Processing condition

| | |
|---|---|
| Developing time: | 4 sec. |
| Fixing time: | 3.1 sec. |
| Washing time: | 2 sec. |
| between washing and drying (squeegee): | 1.6 |
| Drying time: | 4.3 sec. |
| Total processing time: | 15 sec. |

Photographic materials were evaluated in a manner similar to Example 1, based on the above processing. Replenishing rates of the developer and fixed each were 125 ml/m$^2$. Results thereof are shown in Table 4.

Developer composition

Composition per 1000 ml of water is as follows. The pH of the developer was 10.70.

| | |
|---|---|
| Potassium carbonate | 100.0 g |
| Hydroquinone | 75.0 g |
| Dimezone S | 25.0 g |
| Diethylenetriaminepentaacetic acid 5Na (DTPA) | 2.5 g |
| 5-Methylbenzotriazole | 0.25 g |
| 1-Phenyl-5-mercaptotetrazole | 0.18 g |
| 2-Mercaptohypoxanthine | 0.13 g |
| Sodium sulfite | 75.0 g |
| Potassium sulfite | 62.5 g |
| KOH | 5.0 g |
| Diethylene glycol | 125.0 g |
| N-acetyl-D,L-penicillamine | 0.25 g |

Fixer composition

Composition per water of 1000 ml is as follows. The pH of the fixer was 4.50.

| | |
|---|---|
| Sodium thiosulfate | 84.0 g |
| Potassium thiosulfate | 196 g |
| Sodium sulfite | 30.0 g |
| Boric acid | 20.0 g |
| Sodium hydrogen acetate | 60.0 g |
| Glacial acetic acid | 34.6 g |
| Sodium acetate | 25.4 g |
| Tartaric acid | 4.0 g |

TABLE 4

| Sample No. | Emulsion No. | Intensifying screen 1 Process-2 Fog | S | Graininess | Intensifying screen 2 Process-2 Fog | S | Graininess | Remarks |
|---|---|---|---|---|---|---|---|---|
| 1 | EM-1 | 0.10 | 87 | D | 0.09 | 53 | D | Comp. |
| 2 | EM-2 | 0.10 | 90 | D | 0.09 | 55 | D | Comp. |
| 3 | EM-3 | 0.02 | 113 | B | 0.01 | 69 | B | Inv. |
| 4 | EM-4 | 0.02 | 113 | B | 0.01 | 69 | B | Inv. |
| 5 | EM-5 | 0.02 | 118 | A | 0.01 | 72 | A | Inv. |
| 6 | EM-6 | 0.09 | 88 | C | 0.08 | 54 | D | Comp. |
| 7 | EM-7 | 0.09 | 89 | D | 0.08 | 54 | D | Comp. |
| 8 | EM-8 | 0.02 | 118 | B | 0.01 | 72 | B | Inv. |
| 9 | EM-9 | 0.02 | 118 | A | 0.01 | 72 | A | Inv. |
| 10 | EM-10 | 0.02 | 124 | A | 0.01 | 76 | A | Inv. |
| 11 | EM-11 | 0.09 | 88 | C | 0.08 | 54 | D | Comp. |
| 12 | EM-12 | 0.09 | 88 | D | 0.08 | 54 | D | Comp. |
| 13 | EM-13 | 0.02 | 123 | A | 0.01 | 75 | A | Inv. |
| 14 | EM-14 | 0.02 | 123 | A | 0.01 | 75 | A | Inv. |
| 15 | EM-15 | 0.02 | 129 | A | 0.01 | 79 | A | Inv. |

As can be seen from Table 4, inventive samples were proved to be excellent in sensitivity, fog and graininess, even when processed in Processing-2.

Example 3

Process-3: Processing by the use of a solid processing composition not containing hydroquinone Solid processing compositions for use in replenishing developer were prepared according to the following operations (E) and (F).

Operation (E)

13000 g of sodium erythorbic acid, as a developing agent was ground into grain until an average grain size became 10 μm using a commercially available bandom mill. 4877 g of sodium sulfite, 975 g of phenidone and 1635 g of DTPA were added to this powder and mixed by the mill for 30 min. After granulating the mixture by adding 30 ml of water at room temperature for 10 min., the granulated product was dried for 2 hr. using a fluidized bed dryer at 40° C. to remove moisture contained almost completely. The thus prepared granules was mixed with 2167 g of polyethylene glycol 6000 using a mixer for 10 min. in a room conditioned at 25° C. and 40% R.H. Thereafter, the mixture was subjected to compression-molding on a modified tabletting machine, Tough Press Collect 1527 HU, produced by Kikusui Manufacturing Co., Ltd. to prepare 2500 tablets (A) having a weight of 8.715 g per tablet, for use as developer-replenisher.

Operation (F)

19500 g of potassium carbonate, 8.15 g of 1-phenyl-5-mercaptotetrazole 3.25 g of sodium hydrogen carbonate, 650 g of glutar aldehyde sulfite adduct and 1354 g of polyethylene glycol 6000 were ground to form granules in a similar manner to the operation (E). After granulation, the granules were dried at 50° C. for 30 min. to almost completely remove moisture contained. Thereafter, the mixture was subjected to compression-molding on a modified tabletting machine, Tough Press Collect 1527 HU, produced by Kikusui Manufacturing Co., Ltd. to prepare 2500 tablets (F) having a weight of 9.90 g per tablet, for use as developer-replenisher Tablets for fixer were prepared according to the following operations.

Operation (G)

18560 g of a mixture of ammonium thiosulfate, 1392 g of sodium thiosulfate, 580 g of sodium hydroxide and 2.32 g of disodium ethylenediaminetetraacetate were ground and mixed using commercially available mixing machine. Adding water of 500 ml, the mixture was granulated in a similar manner to the operation (A). After granulation, the granules were dried at 60° C. for 30 min. to almost completely remove moisture contained. The resulting granules were subjected to compression-molding on a modified tabletting machine, Tough Press Collect 1527 HU, produced by Kikusui Manufacturing Co., Ltd. to prepare 2500 tablets (G) having a weight of 8.214 g per tablet, for use as fixed-replenisher.

Operation (H)

1860 g of boric acid, 6500 g of aluminum sulfate 18 hydrate 1860 g of glacial acetic acid and 928 g of sulfuric acid (50 wt % were ground and mixed in a similar manner to the above operation (A). Adding water of 100 ml, the mixture was granulated in a similar manner to the operation (A). After granulation, the granules were dried at 50° C. for 30 min. to almost completely remove moisture contained. The resulting granulates were subjected to compression-molding on a modified tabletting machine, Tough Press Collect 1527 HU, produced by Kikusui Manufacturing Co., Ltd. to prepare 1250 tablets (H) having a weight of 4.459 g per tablet, for use as fixed-replenisher.

Starter

| | |
|---|---|
| Glacial acetic acid | 210 g |
| KBr | 350 g |
| Water to make | 1 liter |

At the start of processing, tablets for developer were dissolved in water to prepare a developer and 330 ml of the starter was added to 16.5 l of the developer to prepare a starting developer solution. The start solution was introduced in a developer bath and processing was started. The pH of the developer solution was 10.45.

Photographic materials prepared in Example 1 were exposed so as to give a density of 1.0 and subjected to running-processing. Processing was carried out using an automatic processor, SRX-502, which was provided with a input member of a solid processing composition and modified so as to complete processing in 15 sec. During running-processing, to the developer solution were added one tablets of (E), two tablets of (F) and 20 ml of water per 0.62 $m^2$ of the photographic material. When each of the tablets (A) and (B) was dissolved in water of 20 ml, the pH was 10.70. To the fixer solution were added 4 tablets of (G) and 2 tablet of (H) per 1.00 $m^3$ with 50 ml of water. Addition of water was started at the same time of that of the tablets and continued at a constant rate further for 10 min. in proportion to a dissolving rate of the solid processing composition.

Processing condition:

Developing time: 4 sec.

Fixing time: 3.1 sec.

Washing time: 2 sec.

between washing and drying (squeegee): 1.6

Drying time: 4.3 sec.

Total processing time: 15 sec.

Photographic materials were evaluated in a manner similar to Example 1, based on the above processing. Replenishing rates of the developer and fixed each were 125 ml/$m^2$.

Developer composition

Composition per 1000 ml of water is as follows. The pH of the developer was 10.70.

| | |
|---|---|
| Potassium carbonate | 120.0 g |
| Sodium erythorbic acid | 40.0 g |
| Diethylenetriaminepentaacetic acid 5Na (DTPA) | 5.0 g |
| 1-Phenyl-5-mercaptotetrazole | 0.05 g |
| Sodium hydrogen carbonate | 20.0 g |
| Phenidone | 3.0 g |
| Sodium sulfite | 15.0 g |
| Polyethylene glycol | 15.0 g |
| Glutar aldehyde sulfite adduct | 4.0 g |

Fixer composition

Composition per water of 1000 ml is as follows. The pH of the fixer was 4.80.

| | |
|---|---|
| Ammonium thiosulfate | 160.0 g |
| Sodium sulfite | 12.0 g |
| Boric acid | 1.0 g |
| Sodium hydroxide | 5.0 g |
| Glacial acetic acid | 10.0 g |
| Aluminum sulfate 18 hydride | 35.0 |

-continued

| | |
|---|---|
| Sulfuric acid (59 wt %) | 5.0 g |
| Disodium ethylenediaminetetraacetate dihydride | 0.02 g |

Results thereof are shown in Table 5.

TABLE 5

| Sample No. | Emulsion No. | Intensifying screen 1 Process-3 Fog | S | Graininess | Intensifying screen 2 Process-3 Fog | S | Graininess | Remarks |
|---|---|---|---|---|---|---|---|---|
| 1 | EM-1 | 0.10 | 85 | D | 0.09 | 52 | D | Comp. |
| 2 | EM-2 | 0.10 | 88 | D | 0.09 | 54 | D | Comp. |
| 3 | EM-3 | 0.02 | 113 | B | 0.01 | 69 | B | Inv. |
| 4 | EM-4 | 0.02 | 113 | B | 0.01 | 69 | B | Inv. |
| 5 | EM-5 | 0.02 | 117 | A | 0.01 | 71 | A | Inv. |
| 6 | EM-6 | 0.08 | 86 | C | 0.07 | 52 | D | Comp. |
| 7 | EM-7 | 0.08 | 87 | D | 0.07 | 53 | D | Comp. |
| 8 | EM-8 | 0.02 | 117 | A | 0.01 | 71 | B | Inv. |
| 9 | EM-9 | 0.02 | 117 | A | 0.01 | 71 | A | Inv. |
| 10 | EM-10 | 0.02 | 123 | A | 0.01 | 75 | A | Inv. |
| 11 | EM-11 | 0.08 | 87 | C | 0.07 | 53 | D | Comp. |
| 12 | EM-12 | 0.08 | 88 | D | 0.07 | 54 | D | Comp. |
| 13 | EM-13 | 0.02 | 120 | A | 0.01 | 73 | A | Inv. |
| 14 | EM-14 | 0.02 | 120 | A | 0.01 | 73 | A | Inv. |
| 15 | EM-15 | 0.02 | 128 | A | 0.01 | 78 | A | Inv. |

As can be seen from Table 5, inventive samples were proved to be excellent in sensitivity, fog and graininess, even when developed with a developer not containing hydroquinone.

What is claimed is:

1. A silver halide black-and-white photographic light sensitive material comprising a support having thereon a silver halide emulsion layer comprising silver halide grains, wherein at least 50% of the total grain projected area is accounted for by tabular grains having a chloride content of 20 mol % or more, two parallel {100} major faces and an average aspect ratio of 2 or more, said tabular grains being prepared by a process comprising the steps of:

(i) forming nuclear grains in the presence of a surfactant comprised of polyalkyleneoxide block copolymer, and ii) causing the nuclear grains to grow to form the tabular grains.

2. The silver halide photographic material of claim 1, wherein said surfactant is represented by the following formula (S), Formula (S)

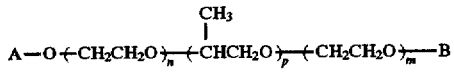

wherein A and B independently represent a hydrogen atom or a substituent; p represents an integer of 15 to 25; m and n each represent an integer, satisfying the following requirement, $(m+n)/p=0.24$ to 0.45.

3. The silver halide photographic material of claim 2, wherein said substituent is selected from a sulfonic acid group carboxy group, alkyl group, aryl group, alkylcarbonyl group, arylcarbonyl group or alkenylcarbonyl group.

4. The silver halide photographic material of claim 1, wherein an iridium compound is added in an amount of $5\times10^{-9}$ to $1\times10^{-4}$ mol per mol of silver halide at a time during the steps of (i) and (ii).

* * * * *